US007698768B2

(12) United States Patent
Cho

(10) Patent No.: US 7,698,768 B2
(45) Date of Patent: Apr. 20, 2010

(54) DRUM TYPE WASHING MACHINE WITH LAUNDRY DRYING FUNCTION AND METHOD FOR CONTROLLING THE SAME

(75) Inventor: Hung Myong Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 880 days.

(21) Appl. No.: 11/317,249

(22) Filed: Dec. 27, 2005

(65) Prior Publication Data

US 2006/0137108 A1 Jun. 29, 2006

(30) Foreign Application Priority Data

Dec. 27, 2004 (KR) ..... 10-2004-0112773
Dec. 27, 2004 (KR) ..... 10-2004-0112774

(51) Int. Cl.
*D06F 35/00* (2006.01)

(52) U.S. Cl. ..... 8/158; 8/159

(58) Field of Classification Search ..... 8/158, 8/159; 68/12.02, 12.03
See application file for complete search history.

(56) References Cited

U.S. PATENT DOCUMENTS 6,497,121 B1 * 12/2002 Walsh et al. ..... 68/19.2
2002/0026673 A1 3/2002 Cho ..... 8/159
2004/0221474 A1 * 11/2004 Slutsky et al. ..... 34/319

FOREIGN PATENT DOCUMENTS

| | | | |
|---|---|---|---|
| DE | 697 21 875 | T2 | 2/2004 |
| JP | 2002-066186 | A | 3/2002 |
| JP | 2002-306893 | A | 10/2002 |
| KR | 10-1999-003656 | | 1/1999 |
| KR | 100208171 | | 4/1999 |
| KR | 10-2003-0069348 | | 8/2003 |
| KR | 10-2003-0090085 | | 11/2003 |
| WO | WO 2005/010267 | A1 | 2/2005 |

OTHER PUBLICATIONS

German Office Action dated Jan. 30, 2007.

* cited by examiner

*Primary Examiner*—Michael Barr
*Assistant Examiner*—Jason Y Ko
(74) *Attorney, Agent, or Firm*—KED & Associates, LLP

(57) ABSTRACT

A drum type washing machine with a laundry drying function and a method for controlling the same are disclosed, in which a ventilating function is carried out during a dehydrating stroke. The drum type washing machine with a laundry drying function, provided with a ventilating fan, includes a key input unit inputting user's request command, a memory storing a pattern for driving the ventilating fan, during a dehydrating stroke period, a controller controlling the washing machine to carry out a corresponding stroke per course selected through the key input unit and to drive the ventilating fan at a pattern previously stored in the memory when a dehydrating stroke starts, and a fan driver controlling driving of the ventilating fan in accordance with a control signal of the controller.

9 Claims, 8 Drawing Sheets

DRUM TYPE WASHING MACHINE WITH LAUNDRY DRYING FUNCTION AND METHOD FOR CONTROLLING THE SAME

This application claims the benefit of Korean Application No. 10-2004-112773, filed on Dec. 27, 2004, and Korean Application No. 10-2004-112774, filed on Dec. 27, 2004, which are hereby incorporated by reference as if fully set forth herein.

BACKGROUND OF THE INVENTION

1. Field of the Invention

The present invention relates to a drum type washing machine, and more particularly, to a drum type washing machine with a laundry drying function and a method for controlling the same, in which a ventilating function is carried out during a dehydrating stroke.

2. Discussion of the Related Art

In general, a washing machine rotates a rotating tub and a pulsator using a driving force of a motor to carry out a washing stroke, a rinsing stroke, and a dehydrating stroke. The washing machine is an apparatus for washing laundries using friction caused among laundries, washing water and the rotating tub by agitating the laundries and the washing water after drawing them into the rotating tub.

The washing machine is classified into a pulsator type washing machine, an agitator type washing machine, and a drum type washing machine depending on a washing manner.

The drum type washing machine washes laundries by rotating a drum using a driving force of a motor in a state that detergents, washing water, and laundries are thrown into the drum. The drum type washing machine has advantages in that damage of laundries and their entanglement little occur and a beating and scrubbing effect is obtained.

Hereinafter, a related art drum type washing machine with a laundry drying function will be described with reference to the accompanying drawings.

FIG. 1 is a side view illustrating a related art drum type washing machine with a laundry drying function.

As shown in FIG. 1, the related art drum type washing machine with a laundry drying function includes a tub 20, a drum 30, a drying duct 40, and a condensing duct 50. The tub 20 is provided in a cabinet 10 to store washing water therein, and has a hot air inlet 20*a* formed at an upper portion on a front surface and a hot air outlet 20*b* formed at a lower portion on a rear surface. The drum 30 is rotatably provided inside the tub 20, and has a plurality of hot air through holes 30*a* formed with a predetermined arrangement on the front surface. The drying duct 40 is fixably provided on an outer circumference at a top of the tub 20, and has a heater 41 and a ventilating fan 42 to generate hot air. The drying duct 40 has one end connected to the hot air inlet 20*a* of the tub 20 to supply hot air generated inside the tub 20 into the drum 30. The condensing duct 50 is provided at the rear of the tub 20 so that its one end is connected to the hot air outlet 20*b* of the tub 20 and its other end is connected to the drying duct 40. The condensing duct 50 removes moisture contained in the air discharged from the tub 20 and transfers the moisture to the drying duct 40.

Preferably, the tub 20 is formed of plastic by injection molding, and the drum 30 is formed of stainless steel.

Meanwhile, the drying conduct 40 is fixed to the outer circumference at the top of the tub 20 by a fitting member such as a screw. A heat intercepting plate 43 is provided between the tub 20 and the drying duct 40 to prevent heat generated from the drying duct 40 from being transferred to the tub 20.

In other words, the heat intercepting plate 43 is fixed to the outer circumference of the tub 20 and then the drying duct 40 is fixed to the heat intercepting plate 43 by the fitting member such as a screw in a state that the heat intercepting plate 43 is fixed to the tub 20.

Meanwhile, the drum 30 is preferably rotated in a direct driving manner by an outer rotor type motor. However, rotation of the drum 30 is not limited to the above case. The outer rotor type motor includes a shaft 61 axially connected to the drum 30 by passing through the tub 20, a rotor 62 fixed to a rear end of the shaft 61, and a stator 63 positioned inside the rotor 62. Also, a radiating means such as radiating fins may be provided on an upper surface of the drying duct 40 to prevent the upper surface of the drying duct 40 from being overheated.

The operation of the aforementioned drum type washing machine will be described as follows.

First, the hot air inlet 20*a* is formed at the upper portion on the front surface of the tub 20, and the hot air outlet 20*b* is formed at the lower portion on the rear surface of the tub 20. This is to form an inlet direction of hot air flown into the drum 30 and an outlet direction of hot air discharged to the condensing duct 50 along a diagonal direction, thereby discharging the hot air after uniformly distributing the hot air to the whole portion inside the drum including a corner portion.

In other words, the hot air through holes 30*a* on the front surface of the drum 30 are formed to obtain a maximum sectional area of a passageway without deteriorating strength at the front surface of the drum.

The hot air through holes 30*a* are formed in an effective arrangement on the front surface of the drum 30 so that the hot air inlet 120 communicates with the hot air through holes 30*a* even in case where the drum 30 is rotated. Therefore, the hot air flown into the tub 20 through the hot air inlet 20*a* is desirably supplied into the drum 30 through the hot air through holes 30*a* provided on the front surface of the drum 30.

Meanwhile, the heat intercepting plate 43 is provided below the drying duct 40. The heat intercepting plate 43 prevents heat generated from the drying duct 40 from being transferred to the tub 20.

Since the drying duct 40 is fixed to the outer circumference of the tub through the heat intercepting plate, a gasket that absorbs vibration is not required at a portion where the drying duct 40 is connected with the tub 20. This is because that the drying duct 40 is moved or vibrated along with the tub 20 if the tub 20 is moved or vibrated as the drying duct 40 is fixed to the tub 20.

It is apparent to those skilled in the art that a sealing member may be provided at the portion where the drying duct 40 is connected with the tub 20, so as to prevent heat generated from the drying duct 40 from being leaked out.

Meanwhile, a gasket that absorbs vibration is not required at a portion where the condensing duct 50 is connected with the tub 20 as the condensing duct 50 is directly fixed to the rear surface of the tub 20.

However, the aforementioned related art drum type washing machine with a laundry drying function has the following problems.

First, the time required for the dehydrating stroke is increased as the dehydrating stroke is carried out by conditions previously set depending on each course.

Second, rumple of laundries occurs as the dehydrating stroke is carried out by conditions previously set depending on each course.

Finally, electric charges are increased as the dehydrating stroke and a drying stroke are successively carried out.

SUMMARY OF THE INVENTION

Accordingly, the present invention is directed to a drum type washing machine with a laundry drying function and a method for controlling the same, which substantially obviate one or more problems due to limitations and disadvantages of the related art.

An object of the present invention is to provide a drum type washing machine with a laundry drying function and a method for controlling the same, in which a ventilating function is carried out during a dehydrating stroke.

Another object of the present invention is to provide a drum type washing machine with a laundry drying function and a method for controlling the same, in which the laundry drying function is improved as a ventilating function is carried out during a dehydrating stroke.

Other object of the present invention is to provide a drum type washing machine with a laundry drying function and a method for controlling the same, in which a simple drying function is carried out as heating is made during a dehydrating stroke.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washing machine with a laundry drying function, provided with a ventilating fan, includes a key input unit inputting user's request command, a memory storing a pattern for driving the ventilating fan, during a dehydrating stroke period, a controller controlling the washing machine to carry out a corresponding stroke per course selected through the key input unit and to drive the ventilating fan at a pattern previously stored in the memory when a dehydrating stroke starts, and a fan driver controlling driving of the ventilating fan in accordance with a control signal of the controller.

Preferably, the pattern for driving the ventilating fan is set such that the ventilating fan is either successively or periodically driven during the dehydrating stroke period.

More preferably, the pattern for driving the ventilating fan is set such that the ventilating fan is driven during a whole dehydrating stroke period, an intermittent dehydrating stroke period, and an original dehydrating stroke period in the dehydrating stroke period.

In another aspect of the present invention, a method for controlling a drum type washing machine with a laundry drying function, provided with a ventilating fan, includes inputting an operation command after selecting user's desired washing course, carrying out a washing stroke and a rinsing stroke corresponding to the selected washing course if the operation command is input, and determining whether a dehydrating stroke starts, and controlling driving of the ventilating fan in accordance with a previously set driving pattern if it is sensed that the dehydrating stroke starts.

Preferably, the step of controlling driving of the ventilating fan in accordance with a previously set driving pattern includes controlling successive driving of the ventilating fan per set dehydrating stroke period if the previously set driving pattern is selected as successive driving of the ventilating fan, and controlling periodical driving of the ventilating fan per set dehydrating stroke period if the previously set driving pattern is selected as periodical driving of the ventilating fan.

More preferably, the step of controlling successive driving of the ventilating fan includes successively driving the ventilating fan during the whole dehydrating stroke period if the set period corresponds to the whole dehydrating stroke period, successively driving the ventilating fan during the intermittent dehydrating stroke period if the set period corresponds to the intermittent dehydrating stroke period, and successively driving the ventilating fan during the original dehydrating stroke period if the set period corresponds to the original dehydrating stroke period.

More preferably, the step of controlling periodical driving of the ventilating fan includes controlling driving of the ventilating fan at a previously set time period if the set period corresponds to the whole dehydrating stroke period, controlling driving of the ventilating fan at a previously set time period during the intermittent dehydrating stroke period if the set period corresponds to the intermittent dehydrating stroke period, and controlling driving of the ventilating fan at a previously set time period during the original dehydrating stroke period if the set period corresponds to the original dehydrating stroke period.

In still another aspect of the present invention, a drum type washing machine with a laundry drying function, provided with a ventilating fan and a heater, includes a key input unit inputting user's request command, a memory storing a pattern for driving the ventilating fan and the heater, during a dehydrating stroke, a temperature sensor sensing a temperature inside a drum, a controller controlling the washing machine to carry out a corresponding stroke per course selected through the key input unit and to drive the ventilating fan and the heater at a pattern previously stored in the memory when the dehydrating stroke starts, a fan driver controlling driving of the ventilating fan in accordance with a control signal of the controller, and a heater driver controlling driving of the heater in accordance with the control signal of the controller.

Preferably, the pattern for driving the ventilating fan and the heater is set such that the ventilating fan is either successively or periodically driven during a dehydrating stroke period and the heater is driven in accordance with a previously set temperature condition or a previously set dryness condition.

More preferably, the pattern for driving the ventilating fan and the heater is set such that the ventilating fan is driven during a whole dehydrating stroke period, an intermittent dehydrating stroke period, and an original dehydrating stroke period in the dehydrating stroke period, and a driving temperature of the heater is either previously set or variable.

In further still another aspect of the present invention, a method for controlling a drum type washing machine with a laundry drying function, provided with a heater and a ventilating fan, includes inputting an operation command after selecting user's desired washing course, carrying out a washing stroke and a rinsing stroke corresponding to the selected washing course if the operation command is input, and determining whether a dehydrating stroke starts, and controlling driving of the heater and the ventilating fan in accordance with a previously set driving pattern if it is sensed that the dehydrating stroke starts.

Preferably, the step of controlling driving of the heater and the ventilating fan in accordance with a previously set driving pattern includes controlling the heater at a previously set temperature and at the same time controlling successive driving of the ventilating fan per set dehydrating stroke period if the previously set driving pattern is selected as successive driving of the ventilating fan, and controlling the heater at the previously set temperature and at the same time controlling periodical driving of the ventilating fan per set dehydrating stroke period if the previously set driving pattern is selected as periodical driving of the ventilating fan.

More preferably, the step of controlling the heater at the previously set temperature and at the same time controlling successive driving of the ventilating fan includes successively driving the ventilating fan during the whole dehydrating stroke period if the set period corresponds to the whole dehydrating stroke period, successively driving the ventilating fan during the intermittent dehydrating stroke period if the set period corresponds to the intermittent dehydrating stroke period, and successively driving the ventilating fan during the original dehydrating stroke period if the set period corresponds to the original dehydrating stroke period.

More preferably, the step of controlling the heater at the previously set temperature and at the same time controlling periodical driving of the ventilating fan includes controlling driving of the ventilating fan at a previously set time period if the set period corresponds to the whole dehydrating stroke period, controlling driving of the ventilating fan at the previously set time period during the intermittent dehydrating stroke period if the set period corresponds to the intermittent dehydrating stroke period, and controlling driving of the ventilating fan at the previously set time period during the original dehydrating stroke period if the set period corresponds to the original dehydrating stroke period.

More preferably, the step of controlling driving of the heater and the ventilating fan in accordance with a previously set driving pattern includes selectively driving the heater at a first set pattern or a second set pattern depending on whether the set pattern reaches the previously set dryness condition, and successively driving the ventilating fan during the whole dehydrating stroke period if the set period corresponds to the whole dehydrating stroke period, successively driving the ventilating fan during the intermittent dehydrating stroke period if the set period corresponds to the intermittent dehydrating stroke period, and successively driving the ventilating fan during the original dehydrating stroke period if the set period corresponds to the original dehydrating stroke period.

More preferably, the first set pattern is set such that the heater is turned on/off at a first previously set temperature period, the second set pattern is set such that the heater is turned on/off at a second previously set temperature period, and the first set temperature is greater than the second set temperature.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
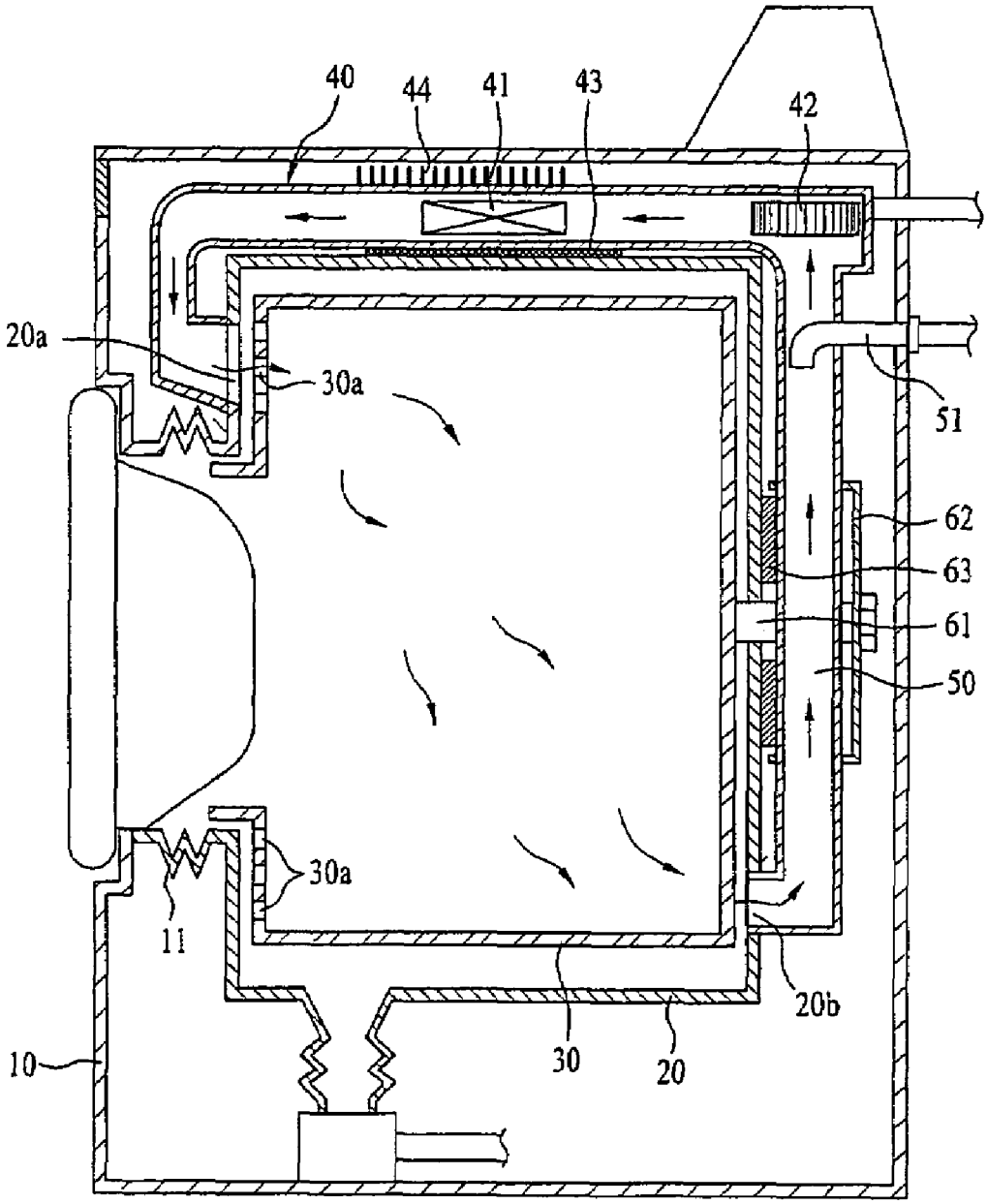
FIG. 1 Prior Art
FIG. 1 is a side view illustrating a related art drum type washing machine.
Figure 2:
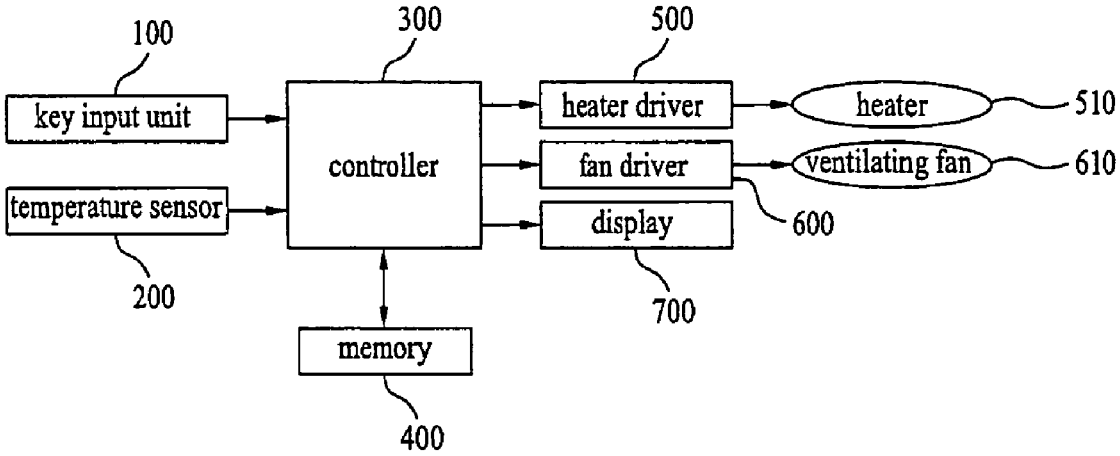
FIG. 2 is a block diagram illustrating structural elements of a drum type washing machine according to the preferred embodiment of the present invention.

A drum type washing machine according to the present invention, as shown in FIG. 2, includes a key input unit 100, a memory 400, a temperature sensor 200, a controller 300, a fan driver 600, a heater driver 500, and a display 700. The key input unit 100 is to input user's request command. A pattern for driving a ventilating fan 610 and a heater 510 is stored in the memory 400. The temperature sensor 200 serves to sense a temperature inside a drum. The controller 300 controls a corresponding stroke per course selected through the key input unit 100 and also controls the ventilating fan 610 and the heater 510 so that they are driven at the pattern previously stored in the memory during a dehydrating stroke. The fan driver 600 controls driving of the ventilating fan 610 depending on a control signal of the controller 300. The heater driver 500 controls driving of the heater 510 depending on the control signal of the controller 300. The display 700 displays the operation status of the washing machine and so on.

The operation of the aforementioned drum type washing machine according to the present invention will now be described.

First, if a user selects a desired washing course after inputting a power-on command through the key input unit 100, the controller 300 controls the washing machine to carry out a corresponding washing stroke in accordance with the washing course selected by the user.

In other words, a washing stroke and a rinsing stroke are sequentially carried out in accordance with the selected washing course, and a dehydrating stroke starts to be carried out after the rinsing stroke is finished. Then, the controller 300 senses that the dehydrating stroke starts to be carried out and controls the heater 510 and the ventilating fan 610 to selectively drive them in accordance with the previously set pattern.

There are a plurality of manners that drive the heater 510. Among them, in the first manner, if a temperature for driving the heater 510 is set and reaches a corresponding set temperature, driving of the heater 510 is stopped. If the temperature for driving the heater 510 is less than the corresponding set temperature, the heater 510 is driven.

Furthermore, there is a manner that varies the set temperature of the heater 510. In this manner, a dryness condition is previously set, and the heater 510 is driven at a first set pattern until it reaches the set dryness condition. After the heater 510 reaches the set dryness condition, it is driven at a second set pattern.

At this time, in the first set pattern, the heater 510 is driven at high temperature until it reaches the set dryness in such a manner that the heater 510 is turned on at 103° C. while it is turned off at 105° C.

In the second set pattern, the heater 510 is driven at low temperature in such a manner that the heater 510 is turned on at 87° C. while it is turned off at 90° C.

In addition to driving of the heater as above, the ventilating fan 610 is also driven during the dehydrating stroke. Various patterns may be used in such a manner that the ventilating fan 610 is successively or periodically driven.

Therefore, as the heater 510 and the ventilating fan 610 are selectively driven during the dehydrating stroke, it exerts an influence on a drying stroke, which is carried out after the dehydrating stroke.

First Embodiment

In a method for controlling a drum type washing machine with a laundry drying function according to the first embodiment of the present invention, a ventilating fan is selectively driven in accordance with a previously set period during a dehydrating stroke.

Figure 3:
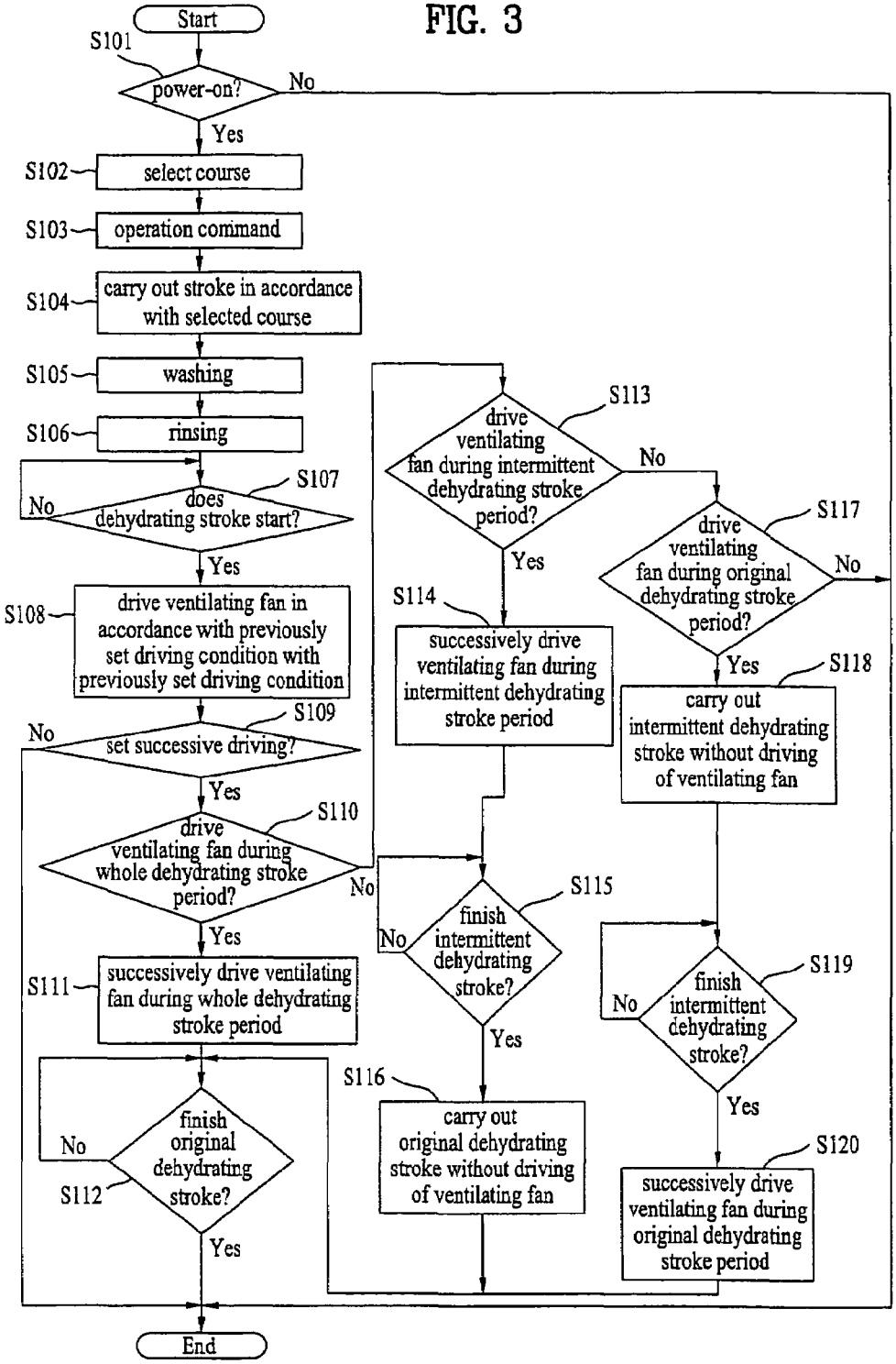
FIG. 3 is a flow chart illustrating a method for controlling a drum type washing machine with a laundry drying function according to the first embodiment of the present invention.

Referring to FIG. 3 illustrating the method for controlling the drum type washing machine with a laundry function according to the first embodiment of the present invention, a user selects its desired washing course after inputting a power-on command (S101~S102).

Subsequently, if the user inputs an operation command after selecting the desired washing course, the washing machine sequentially carries out a washing stroke and a rinsing stroke corresponding to the selected washing course (S103~S106).

If the rinsing stroke is finished, it is determined whether the dehydrating stroke starts to be carried out (S107).

As a result of the step (S107), if the dehydrating stroke starts to be carried out, the ventilating fan is driven in accordance with the previously set driving condition (S108).

Next, it is determined whether the driving condition of the ventilating fan is set as successive driving (S109). As a result of the step (S109), if the successive driving is set, it is determined whether the ventilating fan is to be driven during a whole dehydrating stroke period (S110).

As a result of the step (S110), if the ventilating fan is to be driven during the whole dehydrating stroke period, it is successively driven during the whole dehydrating stroke period (S111).

If the dehydrating stroke is finished, the washing course is ended (S112).

Meanwhile, as a result of the step (S110), if the ventilating fan is not to be driven during the whole dehydrating stroke period, it is determined whether the ventilating fan is to be driven during only an intermittent dehydrating stroke period (S113).

As a result of the step (S113), if the ventilating fan is to be driven during only the intermittent dehydrating stroke period, it is successively driven during only the intermittent dehydrating stroke period, and the dehydrating stroke is carried out during an original dehydrating stroke period without driving of the ventilating fan if the intermittent dehydrating stroke is finished (S114~S116).

As a result of the step (S113), if the ventilating fan is to be driven during only the original dehydrating stroke period, the intermittent dehydrating stroke is carried out without driving of the ventilating fan (S117~S118).

If the intermittent dehydrating stroke is finished, the ventilating fan is successively driven during the original dehydrating stroke period (S119~S120).

Second Embodiment

Figure 4:
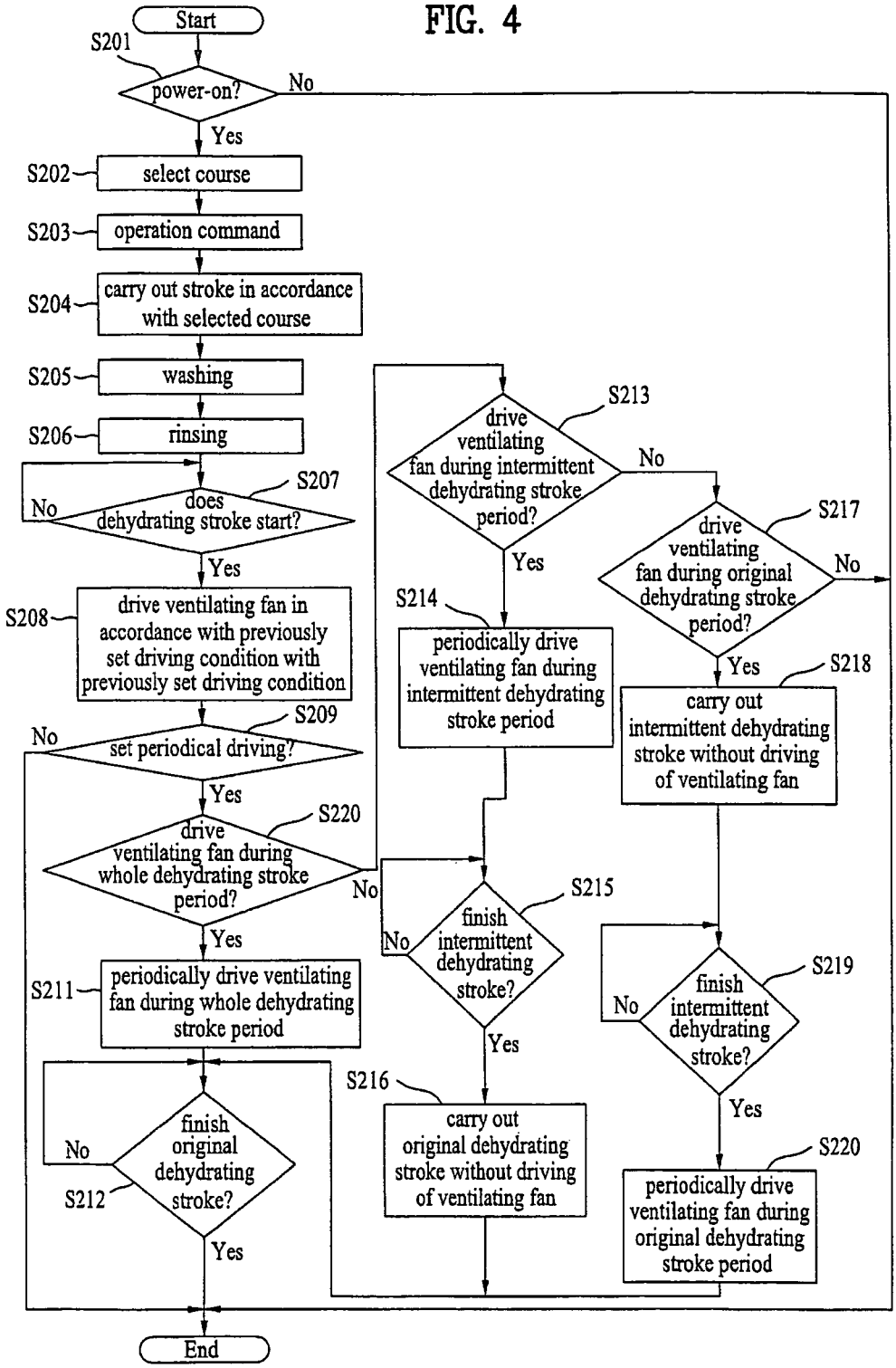
FIG. 4 is a flow chart illustrating a method for controlling a drum type washing machine with a laundry drying function according to the second embodiment of the present invention.

Referring to FIG. 4 illustrating a method for controlling a drum type washing machine with a laundry function according to the second embodiment of the present invention, a user selects its desired washing course after inputting a power-on command (S201~S202).

Subsequently, if the user inputs an operation command after selecting the desired washing course, the washing machine sequentially carries out a washing stroke and a rinsing stroke corresponding to the selected washing course (S203~S206).

If the rinsing stroke is finished, it is determined whether a dehydrating stroke starts to be carried out (S207).

As a result of the step (S207), if the dehydrating stroke starts to be carried out, the ventilating fan is driven in accordance with a previously set driving condition (S208).

Next, it is determined whether the driving condition of the ventilating fan is set as periodical driving (S209).

As a result of the step (S209), if the periodical driving is set, it is determined whether the ventilating fan is to be driven during a whole dehydrating stroke period (S210).

As a result of the step (S210), if the ventilating fan is to be driven during the whole dehydrating stroke period, the ventilating fan is periodically driven during the whole dehydrating stroke period (S211).

If the original dehydrating stroke is finished, the washing course is ended (S212).

Meanwhile, as a result of the step (S210), if the ventilating fan is not to be driven during the whole dehydrating stroke period, it is determined whether the ventilating fan is to be driven during only an intermittent dehydrating stroke period (S213).

As a result of the step (S213), if the ventilating fan is to be driven during only the intermittent dehydrating stroke period, the ventilating fan is periodically driven during only the intermittent dehydrating stroke period, and the dehydrating stroke is carried out during the original dehydrating period without driving of the ventilating fan if the intermittent dehydrating stroke is finished (S214~S216).

As a result of the step (S213), if the ventilating fan is to be driven during only the original dehydrating stroke period not the intermittent dehydrating stroke period, the intermittent dehydrating stroke is carried out without driving of the ventilating fan (S217~S218).

If the intermittent dehydrating stroke is finished, the ventilating fan is periodically driven during the original dehydrating stroke (S219~S220).

As described above, in the drum type washing machine with a laundry drying function and the method for controlling the same according to the present invention, the ventilating fan is successively or periodically driven in accordance with the previously set condition during the dehydrating stroke before a drying stroke is to be carried out.

Hereinafter, an example that the ventilating fan and the heater are together driven will be described.

Third Embodiment

Figure 5:
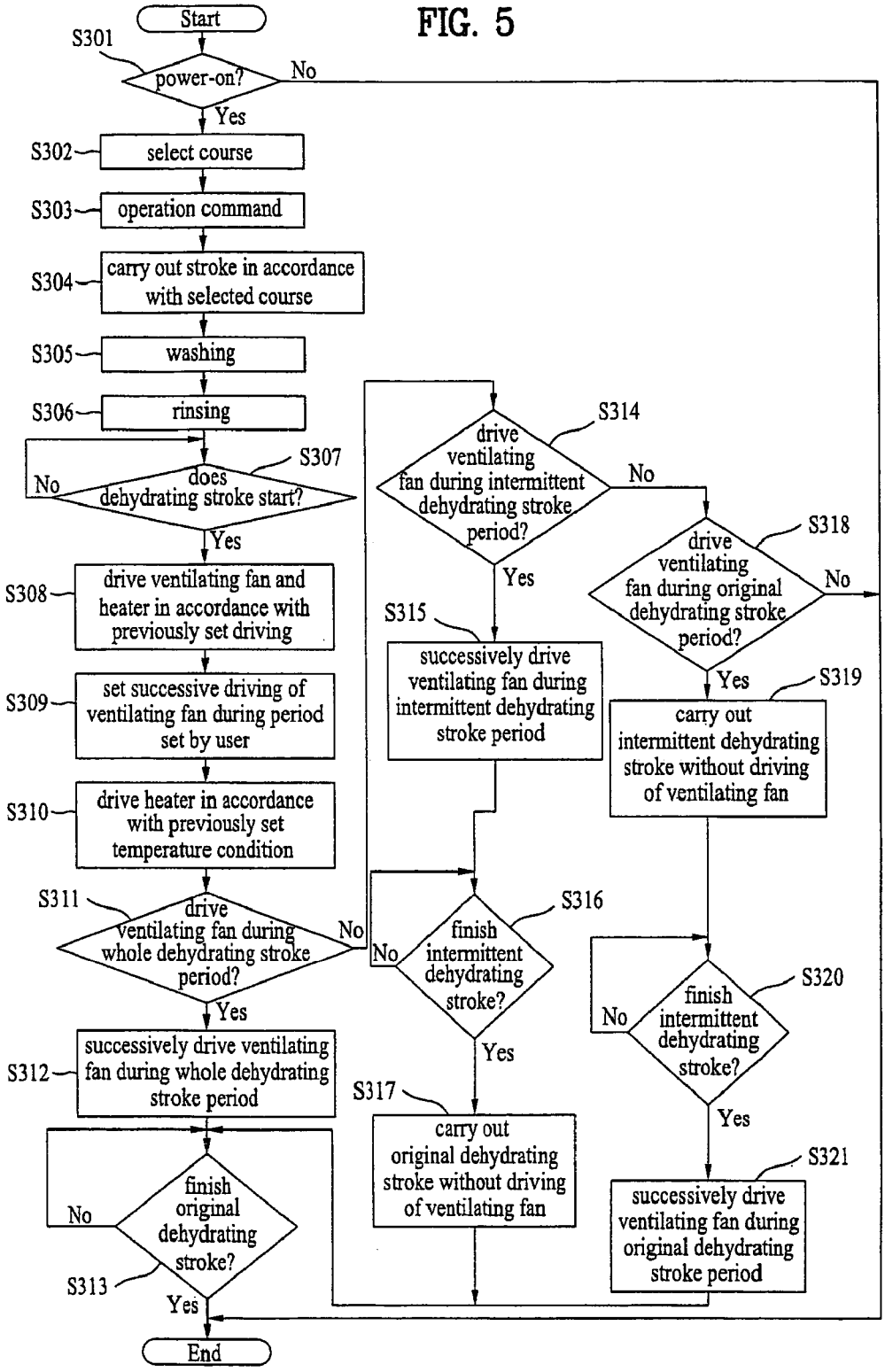
FIG. 5 is a flow chart illustrating a method for controlling a drum type washing machine with a laundry drying function according to the third embodiment of the present invention.

Referring to FIG. 5 illustrating a method for controlling a drum type washing machine with a laundry function according to the third embodiment of the present invention, a user selects its desired washing course after inputting a power-on command (S301~S302).

Subsequently, if the user inputs an operation command after selecting the desired washing course, the washing machine sequentially carries out a washing stroke and a rinsing stroke corresponding to the selected washing course (S303~S306).

If the rinsing stroke is finished, it is determined whether a dehydrating stroke starts to be carried out (S307).

As a result of the step (S307), if the dehydrating stroke starts to be carried out, the ventilating fan and the heater are driven in accordance with a previously set driving condition (S308).

Next, the driving condition of the ventilating fan is set such that the ventilating fan is successively driven during a period set by the user (S309).

The heater is driven in accordance with a previously set temperature condition (S310).

Also, it is determined whether the ventilating fan is to be driven during the whole dehydrating stroke period (S311).

As a result of the step (S311), if the ventilating fan is to be driven during the whole dehydrating stroke period, the ventilating fan is successively driven during the whole dehydrating stroke period until the original dehydrating stroke is finished (S312~S313).

Meanwhile, as a result of the step (S311), if the ventilating fan is not to be driven during the whole dehydrating stroke period, it is determined whether the ventilating fan is to be driven during only an intermittent dehydrating stroke period (S314).

As a result of the step (S314), if the ventilating fan is to be driven during only the intermittent dehydrating stroke period, the ventilating fan is successively driven during only the intermittent dehydrating stroke period (S315).

If the intermittent dehydrating stroke is finished, the original dehydrating stroke is carried out without driving of the ventilating fan (S317). At this time, the heater is successively driven in accordance with the previously set temperature.

Meanwhile, as a result of the step (S314), if the ventilating fan is not to be driven during only the intermittent dehydrating stroke period, it is determined whether the ventilating fan is to be driven during only the original dehydrating stroke period (S318).

As a result of the step (S318), if the ventilating fan is to be driven during only the original dehydrating stroke period, the intermittent dehydrating stroke is carried out without driving of the ventilating fan, and the ventilating fan is successively driven during the original dehydrating stroke period if the intermittent dehydrating stroke is finished (S319~S321).

Fourth Embodiment

In a method for controlling a drum type washing machine with a laundry drying function according to the fourth embodiment of the present invention, a ventilating fan is periodically driven in accordance with a previously set period during a dehydrating stroke and a heater is also driven in accordance with a previously set temperature condition.

Figure 6:
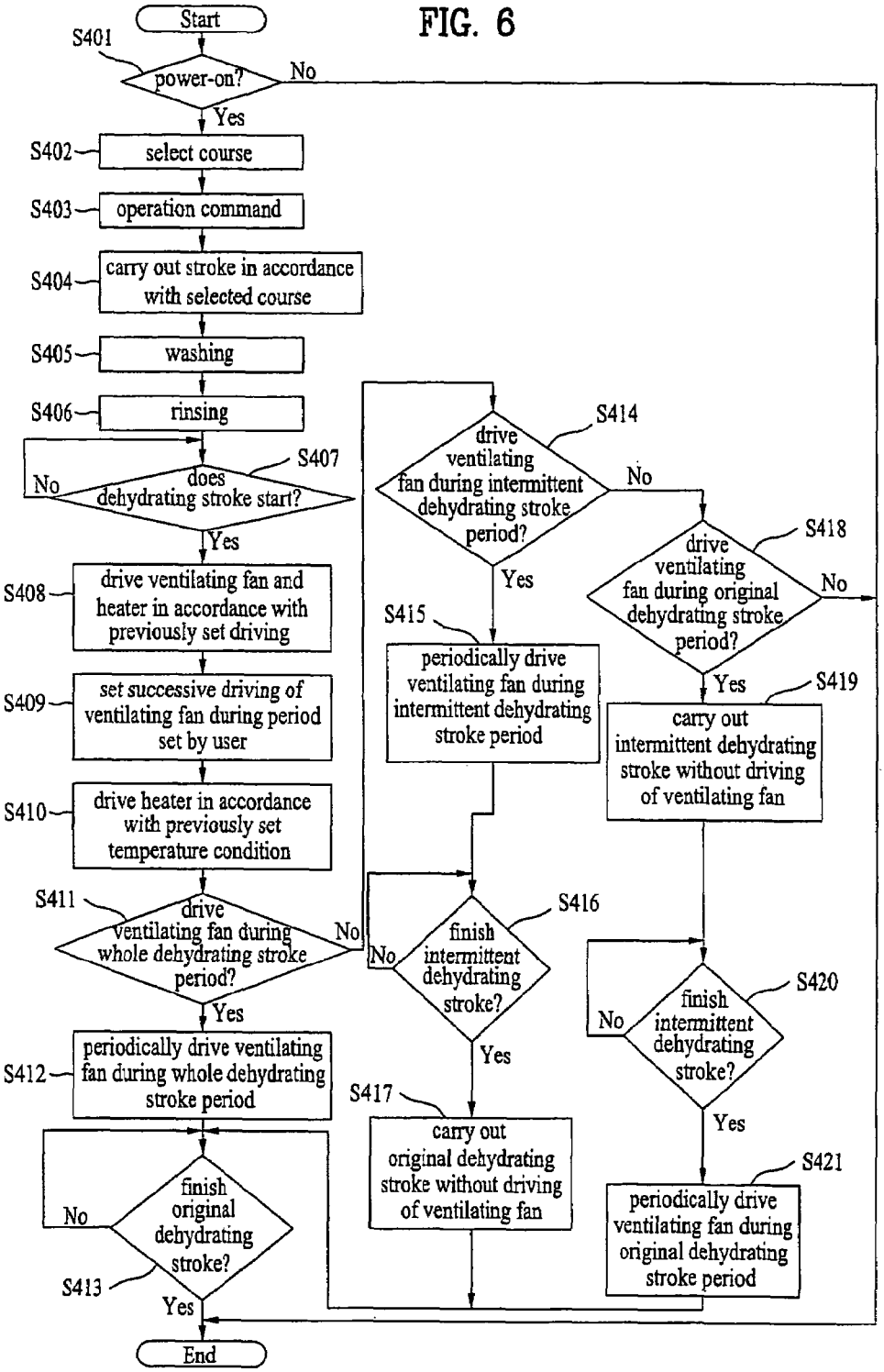
FIG. 6 is a flow chart illustrating a method for controlling a drum type washing machine with a laundry drying function according to the fourth embodiment of the present invention.

Referring to FIG. 6 illustrating the method for controlling the drum type washing machine with a laundry function according to the fourth embodiment of the present invention, a user selects its desired washing course after inputting a power-on command (S401~S402).

Subsequently, if the user inputs an operation command after selecting the desired washing course, the washing machine sequentially carries out a washing stroke and a rinsing stroke corresponding to the selected washing course (S403~S406).

If the rinsing stroke is finished, it is determined whether the dehydrating stroke starts to be carried out (S407).

As a result of the step (S407), if the dehydrating stroke starts to be carried out, the ventilating fan and the heater are driven in accordance with a previously set driving condition (S408).

Next, the driving condition of the ventilating fan is set such that the ventilating fan is periodically driven during a period set by the user (S409).

The heater is driven in accordance with the previously set temperature condition (S410).

Also, it is determined whether the ventilating fan is to be driven during the whole dehydrating stroke period (S411).

Subsequently, as a result of the step (S411), if the ventilating fan is to be driven during the whole dehydrating stroke period, the ventilating fan is periodically driven during the whole dehydrating stroke period until the original dehydrating stroke is finished (S412~S413).

Meanwhile, as a result of the step (S411), if the ventilating fan is not to be driven during the whole dehydrating stroke period, it is determined whether the ventilating fan is to be driven during only the intermittent dehydrating stroke period (S414).

As a result of the step (S414), if the ventilating fan is to be driven during only the intermittent dehydrating stroke period, the ventilating fan is periodically driven during only the intermittent dehydrating stroke period (S415).

If the intermittent dehydrating stroke is finished, the original dehydrating stroke is carried out without driving of the ventilating fan (S417). At this time, the heater is successively driven in accordance with the previously set temperature.

Meanwhile, as a result of the step (S414), if the ventilating fan is not to be driven during only the intermittent dehydrating stroke period, it is determined whether the ventilating fan is to be driven during only the original dehydrating stroke period (S418).

As a result of the step (S418), if the ventilating fan is to be driven during only the original dehydrating stroke period, the intermittent dehydrating stroke is carried out without driving of the ventilating fan, and the ventilating fan is periodically driven during the original dehydrating stroke if the intermittent dehydrating stroke is finished (S419~S421).

Fifth Embodiment

In a method for controlling a drum type washing machine with a laundry drying function according to the fifth embodiment of the present invention, a ventilating fan is successively driven in accordance with a previously set period during a dehydrating stroke, and a driving temperature of a heater is varied depending on a previously set dryness condition.

Figure 7:
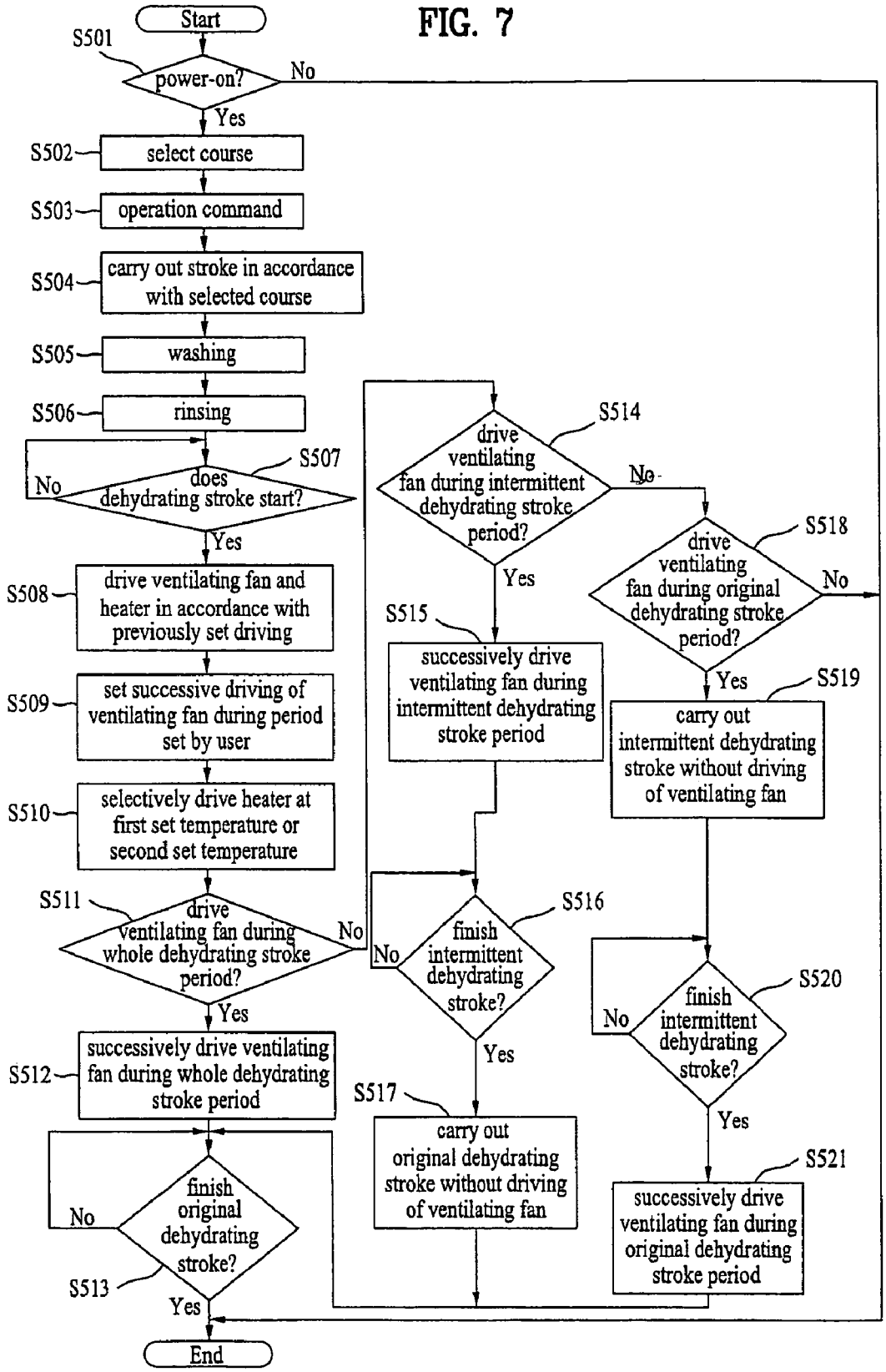
FIG. 7 is a flow chart illustrating a method for controlling a drum type washing machine with a laundry drying function according to the fifth embodiment of the present invention.

Referring to FIG. 7 illustrating the method for controlling the drum type washing machine with a laundry function according to the fifth embodiment of the present invention, a user selects its desired washing course after inputting a power-on command (S501~S502).

Subsequently, if the user inputs an operation command after selecting the desired washing course, the washing machine sequentially carries out a washing stroke and a rinsing stroke corresponding to the selected washing course (S503~S506).

If the rinsing stroke is finished, it is determined whether the dehydrating stroke starts to be carried out (S507).

As a result of the step (S507), if the dehydrating stroke starts to be carried out, the ventilating fan and the heater are driven in accordance with a previously set driving condition (S508).

Next, the driving condition of the ventilating fan is set such that the ventilating fan is successively driven during a period set by the user (S509).

The heater is driven at a first set pattern or a second set pattern previously set depending on whether the set pattern reaches the previously set dryness condition (S510).

Also, it is determined whether the ventilating fan is to be driven during the whole dehydrating stroke period (S511).

Subsequently, as a result of the step (S511), if the ventilating fan is to be driven during the whole dehydrating stroke period, the ventilating fan is successively driven during the whole dehydrating stroke period until the original dehydrating stroke is finished (S512~S513).

Meanwhile, as a result of the step (S511), if the ventilating fan is not to be driven during the whole dehydrating stroke period, it is determined whether the ventilating fan is to be driven during only the intermittent dehydrating stroke period (S514).

As a result of the step (S514), if the ventilating fan is to be driven during only the intermittent dehydrating stroke period, the ventilating fan is successively driven during only the intermittent dehydrating stroke period (S515).

If the intermittent dehydrating stroke is finished, the original dehydrating stroke is carried out without driving of the ventilating fan (S517). In this case, the heater is driven at the first set pattern or the second pattern depending on whether the set pattern reaches the previously set dryness condition.

At this time, the set dryness condition is in the range of 87% to 90%. The heater is turned on at 103° C. while it is turned off at 105° C. in accordance with the first set pattern so that the heater can quickly reach the set dryness condition. Also, if the heater reaches the set dryness condition, the heater is turned on at 87° C. while it is turned off at 90° C. in accordance with the second set pattern. In this way, heating is carried out during the dehydrating stroke.

Meanwhile, as a result of the step (S514), if the ventilating fan is not to be driven during only the intermittent dehydrating stroke period, it is determined whether the ventilating fan is to be driven during only the original dehydrating stroke period (S518).

As a result of the step (S518), if the ventilating fan is to be driven during only the original dehydrating stroke period, the intermittent dehydrating stroke is carried out without driving of the ventilating fan, and the ventilating fan is successively driven during the original dehydrating stroke period if the intermittent dehydrating stroke is finished (S519~S521).

Sixth Embodiment

In a method for controlling a drum type washing machine with a laundry drying function according to the sixth embodiment of the present invention, a ventilating fan is periodically driven in accordance with a previously set period during a dehydrating stroke, and a driving temperature of a heater is selectively varied depending on a previously set dryness condition.

Figure 8:
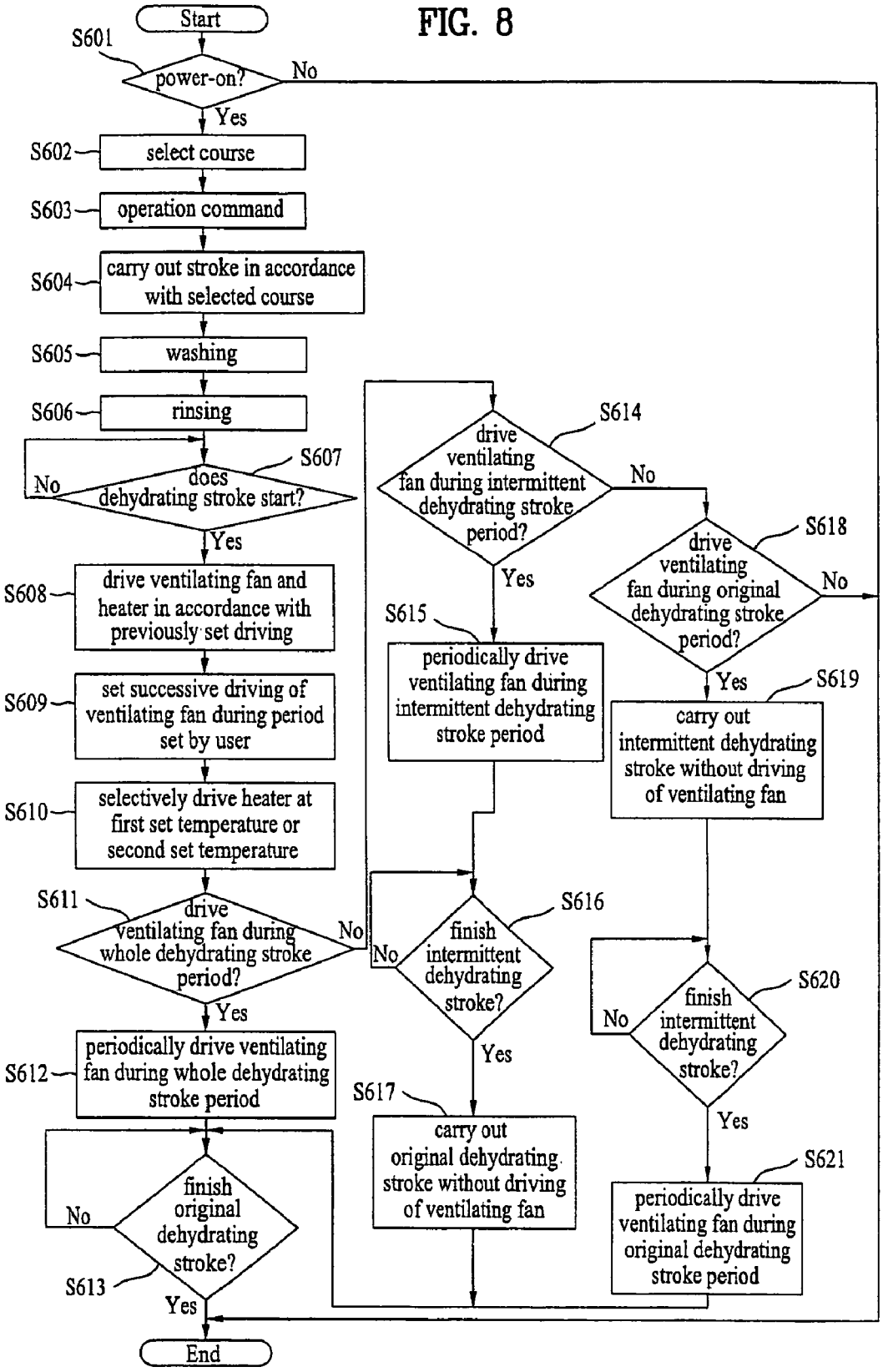
FIG. 8 is a flow chart illustrating a method for controlling a drum type washing machine with a laundry drying function according to the sixth embodiment of the present invention.

Referring to FIG. 8 illustrating the method for controlling the drum type washing machine with a laundry function according to the sixth embodiment of the present invention, a user selects its desired washing course after inputting a power-on command (S601~S602).

Subsequently, if the user inputs an operation command after selecting the desired washing course, the washing machine sequentially carries out a washing stroke and a rinsing stroke corresponding to the selected washing course (S603~S606).

If the rinsing stroke is finished, it is determined whether the dehydrating stroke starts to be carried out (S607).

As a result of the step (S607), if the dehydrating stroke starts to be carried out, the ventilating fan and the heater are driven in accordance with a previously set driving condition (S608).

Next, the driving condition of the ventilating fan is set such that the ventilating fan is periodically driven during a period set by the user (S609).

The heater is driven at a first set pattern or a second set pattern previously set depending on whether the set pattern reaches the previously set dryness condition (S610).

Also, it is determined whether the ventilating fan is to be driven during the whole dehydrating stroke period (S611).

Subsequently, as a result of the step (S611), if the ventilating fan is to be driven during the whole dehydrating stroke period, the ventilating fan is periodically driven during the whole dehydrating stroke period until the original dehydrating stroke is finished (S612~S613).

Meanwhile, as a result of the step (S611), if the ventilating fan is not to be driven during the whole dehydrating stroke period, it is determined whether the ventilating fan is to be driven during only the intermittent dehydrating stroke period (S614).

As a result of the step (S614), if the ventilating fan is to be driven during only the intermittent dehydrating stroke period, the ventilating fan is periodically driven during only the intermittent dehydrating stroke period (S615).

If the intermittent dehydrating stroke is finished, the original dehydrating stroke is carried out without driving of the ventilating fan (S617). In this case, the heater is driven at the first set pattern or the second pattern depending on whether the set pattern reaches the previously set dryness condition.

At this time, the set dryness condition is in the range of 87% to 90%. The heater is turned on at 103° C. while it is turned off at 105° C. in accordance with the first set pattern so that the heater can quickly reach the set dryness condition. Also, if the heater reaches the set dryness condition, the heater is turned on at 87° C. while it is turned off at 90° C. in accordance with the second set pattern. In this way, heating is carried out during the dehydrating stroke.

Meanwhile, as a result of the step (S614), if the ventilating fan is not to be driven during only the intermittent dehydrating stroke period, it is determined whether the ventilating fan is to be driven during only the original dehydrating stroke period (S618).

As a result of the step (S618), if the ventilating fan is to be driven during only the original dehydrating stroke period, the intermittent dehydrating stroke is carried out without driving of the ventilating fan, and the ventilating fan is periodically driven during the original dehydrating stroke if the intermittent dehydrating stroke is finished (S619~S621).

As described above, in the drum type washing machine with a laundry drying function and the method for controlling the same according to the present invention, hot air is successively or periodically supplied into the washing machine through the heater and the ventilating fan during the dehydrating stroke.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a drum type washing machine with a laundry drying function, provided with a ventilating fan, the method comprising:

inputting an operation command after selecting a user's desired washing course;

carrying out a washing stroke and a rinsing stroke corresponding to the selected washing course if the operation command is input, and determining whether a dehydrating stroke starts; and driving the ventilating fan during the dehydrating stroke in accordance with a previously set driving pattern if it is sensed that the dehydrating stroke starts, wherein driving the ventilating fan includes successively driving the ventilating fan during a set dehydrating stroke period, or periodically driving the ventilating fan during a set dehydrating stroke period, wherein successively driving the ventilating fan includes:

successively driving the ventilating fan during a whole dehydrating stroke period if the set period corresponds to the whole dehydrating stroke period;

successively driving the ventilating fan during an intermittent dehydrating stroke period if the set period corresponds to the intermittent dehydrating stroke period; and successively driving the ventilating fan during an original dehydrating stroke period if the set period corresponds to the original dehydrating stroke period, and wherein periodically driving the ventilating fan includes:

driving the ventilating fan at previously set intervals during a whole dehydrating stroke period if the set period corresponds to the whole dehydrating stroke period;

driving the ventilating fan at the previously set intervals during an intermittent dehydrating stroke period if the set period corresponds to the intermittent dehydrating stroke period; and driving the ventilating fan at the previously set intervals during an original dehydrating stroke period if the set period corresponds to the original dehydrating stroke period.

2. The method as claimed in claim 1, wherein the ventilating fan blows air into a drum during the dehydrating stroke period.

3. A method for controlling a drum type washing machine with a laundry drying function, provided with a heater and a ventilating fan, the method comprising:

inputting an operation command after selecting a user's desired washing course;

carrying out a washing stroke and a rinsing stroke corresponding to the selected washing course if the operation command is input, and determining whether a dehydrating stroke starts; and driving the heater and the ventilating fan during the dehydrating stroke in accordance with a previously set driving pattern if it is sensed that the dehydrating stroke starts, wherein said driving includes one of:

(a) driving the heater and at a same time successively driving the ventilating fan, said driving including:

successively driving the ventilating fan during a whole dehydrating stroke period if a set period corresponds to the whole dehydrating stroke period;

successively driving the ventilating fan during an intermittent dehydrating stroke period if the set period corresponds to the intermittent dehydrating stroke period; and successively driving the ventilating fan during an original dehydrating stroke period if the set period corresponds to the original dehydrating stroke period, or (b) driving the heater and at a same time periodically driving the ventilating fan, said driving including:

driving the ventilating fan at previously set intervals during a whole dehydrating stroke period if a set period corresponds to the whole dehydrating stroke period;

driving the ventilating fan at the previously set intervals during an intermittent dehydrating stroke period if the set period corresponds to the intermittent dehydrating stroke period; and driving the ventilating fan at the previously set intervals during an original dehydrating stroke period if the set period corresponds to the original dehydrating stroke period.

4. The method as claimed in claim 3, wherein driving the heater and the ventilating fan includes:

driving the heater based on a previously set temperature and at a same time successively driving the ventilating fan during a set dehydrating stroke period, or driving the heater based on the previously set temperature and at the same time periodically driving the ventilating fan during a set dehydrating stroke period.

5. The method as claimed in claim 4, wherein driving the heater based on a previously set temperature comprises:

if a temperature in a drum is less than the previously set temperature, driving the heater; and if the temperature in the drum reaches the previously set temperature, stopping the heater.

6. The method as claimed in claim 3, wherein the driving the heater and the ventilating fan includes:

selectively driving the heater by a first set pattern or a second set pattern depending on whether a dryness of an air in a drum reaches the previously set dryness condition, and successively driving the ventilating fan during a whole dehydrating stroke period if the set period corresponds to the whole dehydrating stroke period;

successively driving the ventilating fan during an intermittent dehydrating stroke period if the set period corresponds to the intermittent dehydrating stroke period; and successively driving the ventilating fan during an original dehydrating stroke period if the set period corresponds to the original dehydrating stroke period.

7. The method as claimed in claim 6, wherein the first set pattern is set such that the heater is driven between a first maximum and minimum temperatures, the second set pattern is set such that the heater is driven between second maximum and minimum temperatures, and the first maximum and minimum temperatures are greater than the second maximum and minimum temperatures.

8. The method as claimed in claim 3, wherein the ventilating fan blows air into a drum during the dehydrating stroke period.

9. The method as claimed in claim 3, wherein the heater heats air during the dehydrating stroke period, and the ventilating fan blows the heated air into a drum.

* * * * *